US005272004A

United States Patent [19]

Tabata et al.

[11] Patent Number: 5,272,004

[45] Date of Patent: Dec. 21, 1993

[54] CARBON FIBERS AND PROCESS FOR PRODUCING THE SAME

[75] Inventors: Hirofumi Tabata; Akio Takamatsu, both of Kamisumachi, Japan

[73] Assignee: Petoca Ltd., Tokyoto, Japan

[21] Appl. No.: 972,712

[22] Filed: Nov. 6, 1992

Related U.S. Application Data

[63] Continuation-in-part of Ser. No. 321,802, Mar. 10, 1989, abandoned.

[30] Foreign Application Priority Data

Mar. 17, 1988 [JP] Japan ..... 63-61945

[51] Int. Cl.[5] ..... D02G 3/00

[52] U.S. Cl. ..... 428/364; 428/362; 428/367; 264/29.2; 423/447.1; 423/447.2

[58] Field of Search ..... 57/236, 243; 264/29.2; 423/447.1, 447.2; 428/359, 362, 364, 367, 408, 371, 369

[56] References Cited

U.S. PATENT DOCUMENTS

| | | | |
|---|---|---|---|
| 2,578,743 | 12/1951 | Rosenthal | 428/362 |
| 3,702,054 | 11/1972 | Araki et al. | 423/447.1 |
| 4,014,725 | 3/1977 | Schulz | 428/367 X |
| 4,084,399 | 4/1978 | Kanemaru et al. | 428/367 X |
| 4,254,181 | 3/1981 | Bromley et al. | 428/362 |
| 4,717,331 | 1/1988 | Maeda et al. | 264/29.2 X |
| 4,837,076 | 6/1989 | McCullough, Jr. | 428/367 |
| 4,850,186 | 7/1989 | Hiramatsu et al. | 423/447.2 X |
| 4,918,912 | 4/1990 | Warner | 428/359 |
| 4,950,533 | 8/1990 | McCullough, Jr. et al. | 428/362 |
| 5,183,603 | 2/1993 | Kitajima et al. | 264/29.2 |

FOREIGN PATENT DOCUMENTS

| | | |
|---|---|---|
| 47-32148 | 11/1969 | Japan . |
| 50-101405 | 1/1975 | Japan . |
| 52-47014 | 10/1975 | Japan . |
| 62-90320 | 10/1985 | Japan . |

*Primary Examiner*—Patrick J. Ryan
*Assistant Examiner*—N. Edwards
*Attorney, Agent, or Firm*—Armstrong, Westerman, Hattori, McLeland & Naughton

[57] ABSTRACT

Pitch-based carbon fiber having from 2 to 200 twists per 1 cm length or from 2 to 200 twists per 1 cm length and curls are provided. These fibers show superior properties as carbon fibers useful for non-woven fabrics or for fabrics.

2 Claims, 2 Drawing Sheets

CARBON FIBERS AND PROCESS FOR PRODUCING THE SAME

This application is a continuation-in-part of application Ser. No. 07/321,802 filed Mar. 10, 1989, now abandoned.

BACKGROUND OF THE INVENTION

This invention relates to pitch-based carbon fibers having superior properties useful for fabrics or non-woven fabrics.

The pitch-based carbon fibers having peculiar twists or twists and curls of the present invention give bulkiness which has not been given by conventional carbon fibers and the non-woven fabrics produced therefrom show superior shape-retaining property, dimensional stability, heat-retaining property and cushioning property.

The pitch-based carbon fibers of the present invention give superior shrinking property, shock absorbing property, heat-retaining property and cushioning property to thread or spun yarn.

Irrespective of natural fibers or artificial fibers, most of fibers useful as raw materials for clothes have twists and curls. It is considered that such a form has a function of improving workability of fibers and has a capability of holding air-containing space. But most of fibers for industrial purpose have a straight form without curls.

Particularly in case of carbon fibers, those which have no twist or curl have been prepared. The reason for this matter is as follows. At the time of production of carbon fibers from fibers of an organic high molecular substance, carbonization treatment is carried out usually under stretching in order to make their strength greater. And by the stretching applied for a long time, strain inherently possessed by the fibers of the organic high molecular substance is lost. On the other hand, since plastic deformation temperature of carbon is higher, designing of facilities for providing secondarily twist or curl is difficult.

Further, in case of pitch-based carbon fibers, the carbonization under stretching is unnecessary. But since precursor fibers have extremely low strength, it is considered that forming twist and curl by providing strain onto the fibers is an intolerable process for the fibers. On this account, in the quality evaluation standard of pitch fibers, there seems to be such a tendency that if a deformation suggesting of the existence of such a strain is not found, quality is regarded to be good.

However, when extensive industrial materials are taken into consideration as use for carbon fibers, it is not a clear-cut point of view that straight yarn is most preferable as in case of the use in fiber composite materials. It is considered that there is naturally a case where non-straight fibers or yarn are preferable if materials of such a shape as non-woven fabrics, spun yarn fabrics or the like are taken into consideration.

It is an object of the present invention to overcome the problem of conventional carbon fibers which are greatly inferior to other artificial fibers in processability due to their straight shape having no twist or curl.

SUMMARY OF THE INVENTION

The present invention resides in pitch-based individual carbon fibers having 2 to 200 twist per 1 cm length or having 2 to 200 twists per 1 cm length and curls.

The pitch-based carbon fibers of the present invention have peculiar twists or twists and curls and give bulkiness which has not been given in case of conventional carbon fibers and the non-woven fabrics produced therefrom show superior shape-retaining property, dimensional stability, heat-retaining property and cushioning property.

BRIEF DESCRIPTION OF THE DRAWINGS

A representative example of the individual carbon fibers of the present invention is shown in FIGS. 1 and 2 by way of photograph taken by a scanning type electron microscope. One example of spinnerets used for spinning the pitch based carbon fibers of the present invention is shown in schematic cross-sectional drawing of FIG. 3.

DETAILED DESCRIPTION OF THE INVENTION

Figure 1:
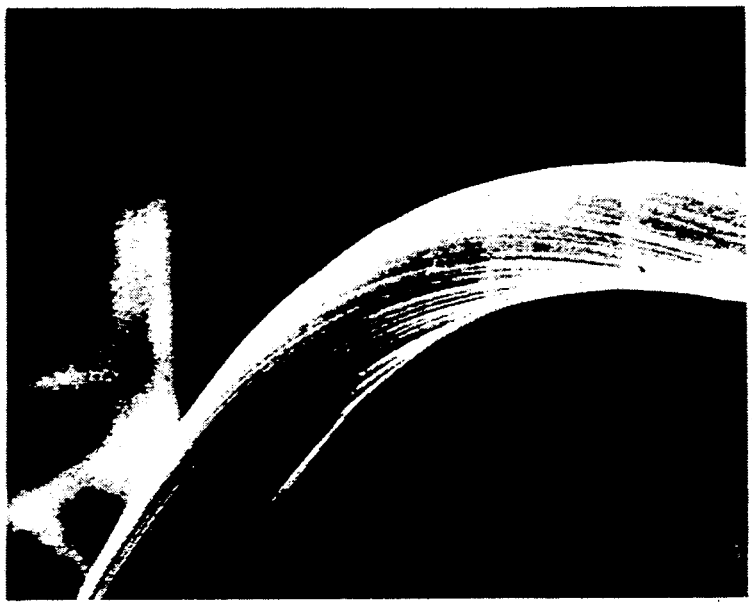
Figure 2:
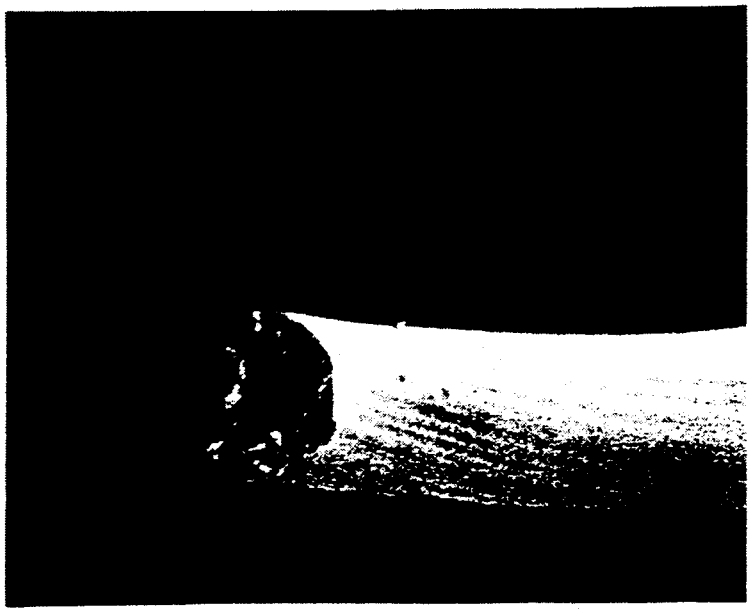

The pitch-based individual carbon fibers of the present invention have twists or twists and curls.

These fibers are not broken by strain during the carbonization, differently from the conventional pitch based carbon fibers having curl, and superior both in strength and elongation.

One of the methods for producing the carbon fibers of the present invention is characterized in cooling spun pitch fibers by a gas stream which has a Reynolds number of from 1 to 250 based upon the diameter of fiber and which is directed to the position where the pitch fibers are yet to coagulate completely.

Reynolds number based upon the diameter of fibers referred to herein is a calculated value Re (no dimensional number) from the following formula.

$$Re = \frac{\text{(fiber diameter) (velocity of gas stream) (gas stream density)}}{\text{(gas stream viscosity)}}$$

A crossing angle of the cooling fluid to the fibers is preferably close to 90° C. It is preferable that it is not smaller than 30° C. It is preferable that the Reynolds number based upon fiber diameter is in the range of from 4 to 25.

It is preferable to flow the cooling fluid so as not directly face to the spinneret. For that purpose, it is preferable to set up a flow-rectification plate near the blowing out nozzle of the cooling fluid or behind the rows of the fibers to flow the cooling fluid while avoiding the spinneret surface. And it is preferable to flow the cooling fluid to cover the running direction of the fibers as long a range as possible so as to complete the coagulation of the pitch fibers during this cooling range.

It is preferable that the cooling range starts from the position apart from the spinneret by 3 mm or more and finishes within 250 mm. The length of the cooling range is preferably to be 20 mm or more and 150 mm or less.

It is preferable to give a certain extent of tension while spinning pitch based fibers. On this account, it is preferable to wind up cooled fibers or pulling them by using ejectors and to use a spinning nozzle having a large spinning hole diameter. The diameter of spinning hole is preferable to be in the range of 0.3 mm to 2.5 mm and most preferable to be in the range of 0.5 mm to 1.2 mm.

As for spinning process, any one of a common melt spinning, a centrifugal type melt spinning and a melt blow type melt spinning are basically applicable. In case of the melt blow type, it is preferable to introduce some special cooling fluid in addition to those which are used for blowing away the pitch in order to control the quality of the fibers. But since this leads to higher cost, it is also allowable to turn the direction of the fluid used for blowing away the pitch by using rectification plates and to introduce an accompanied gas stream therein for cooling.

It is preferable to wind up the pitch fibers which have been finished cooling or to pull by ejectors. But instead of pulling by ejectors, it is possible to generate pulling force by turning the direction of cooling fluid by using rectification plates or the like.

Another production processes of the carbon fibers of the present invention is as follows. In a melt blow type melt-spinning in which pulling is carried out by flowing a high speed gas stream in the vicinity around spinning holes to form pitch fibers by cooling and coagulating, strain is given on the pitch fibers by pulling while flowing a high speed gas stream on one side of extruding pitch stream and a low speed gas stream on the other side thereof. Then, during the subsequent steps of infusibilization and carbonization, deformation is occurred by the strain and twists are observed on the individual fibers.

It is preferable to use a spinneret in which pitch-extruding tubular spinning nozzles are provided in the nozzles from which heated gas streams are blown out, and to use a spinneret in which the pitch spinning nozzles are situated eccentrically in the gas stream nozzles.

This type of spinneret has an advantage that the twists of the individual fibers can be easily varied by controlling the extent of eccentricity of the pitch spinning nozzles. In case of a spinneret in which the pitch spinning nozzle is always situated eccentrically in the gas stream nozzle flaws are liable to be formed during washing and life is shortened. Accordingly, it is preferable, to set the pitch spinning nozzle nearly in the middle of the gas stream nozzle, and to control the degree of eccentricity by sliding a plate on which the pitch spinning nozzle is provided and a plate having the gas stream nozzle therein.

As other type of spinneret, it is possible to use those in which pitch spinning holes are arranged on the pointed end of die having a knife-edge type cross-section and the heated gas is blown out from a knife-edge shape gas blowing out slit provided on both the side of die and to pull and minutely divide the pitch discharged from the spinning holes. In that case, by changing back pressure or resistance (width of the slit or the like) of the gas discharge slit the velocity of the gas stream which contact with the pitch stream is differentiated.

It is possible to wind up the pitch fibers which have been finished cooling, to pull them by ejectors and put them into cans or to deliver them upon a belt conveyor. Alternatively, it is possible to pile up on a belt conveyor by subjecting to suction from the back side of a porous belt such as a net belt conveyor.

Figure 3:
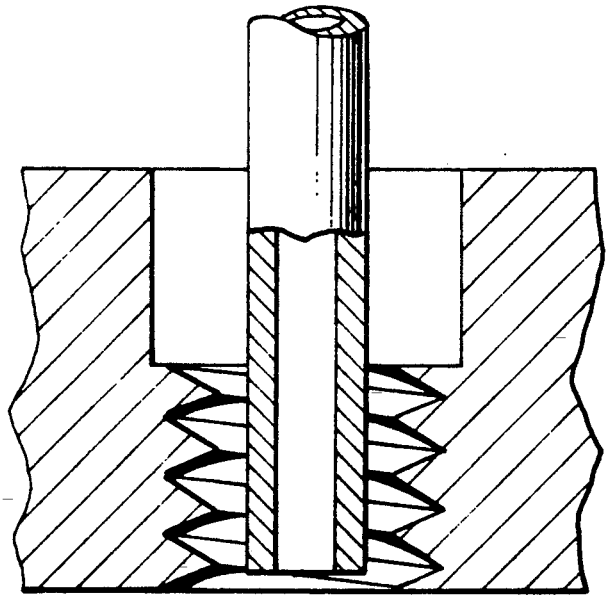

Further, another melt-blow type melt-spinning process of the present invention is the one in which pitch discharging tubular spinning holes are provided in a nozzle for blowing out the revolving heated gas. Various apparatuses which give revolving to the gas stream being blown out from a nozzle have been known, but as shown in FIG. 3, a nozzle having a screw groove in the inside is preferable because of easiness of production.

The revolving of the gas stream does not reach the places far from the nozzle and the force of the gas stream serves for only drawing of fibers. The pitch stream is divided to minute parts by drawing and cooled and coagulated. It is possible to wind up the pitch fibers which have been finished cooling, to draw by ejectors and introduce into cans or to send onto a belt conveyor. Further, it is possible to pile up on a belt by sucking from the back side of a porous belt such as a net conveyor.

The pitch fibers prepared by these methods are subjected to infusibilization and carbonization treatment according to a usual process to produce individual carbon fibers having twists or twists and curls of the present invention.

The pitch which is used in the present invention is a high softening point pitch having a softening point of 180° C. or higher, preferably 235° C. or higher.

Following examples are provided to illustrate the present invention, but they are not provided to limit the scope.

EXAMPLE 1

Spinning was conducted by using a spinneret having 1.0 mm diameter gas stream holes in which pitch-extruding tubular nozzles having an inside diameter of 0.3 mm and an outside diameter of 0.6 mm are accommodated and by pulling out melted pitch by blowing out heated air from circumference of the tubular nozzles. Cooling was conducted by blowing out an air horizontally at a position 5 mm -60 mm underneath the spinneret.

As a raw material pitch, a petroleum based pitch having a softening point of 285° C. and an optically anisotropic proportion of 100% was used. For spinning conditions, followings were adopted.

| | |
|---|---|
| flow rate of pitch: | 12 g/min. |
| pitch temperature: | 320° C. |
| heated gas rate (air): | 0.43 kg/min. |
| temperature of heated gas (air): | 420° C. |
| pressure of heated gas (air): | 1.5 kg/cm$^2$ G |
| spinning hole (hole for pitch discharge): | 0.3 mmϕX74 holes |
| gas discharge hole: | 1.0 mmϕ |
| spinneret temperature: | 420° C. |
| nozzle pressure at the time of no pitch delivery operation: | −540 mm $H_2O$ |
| flow rate of cooling air: | 12 m/sec. |
| cooling air temperature: | 22° C. |
| Re number based upon fiber diameter: | 6.2 |

After spinning was conducted continuously for 6 hours, the resulting non-woven fabrics were subjected to infusibilization and carbonization according to a common process. By picking up samples from random 10 positions of resulting non-woven fabrics of carbon fibers, the shape of fibers was investigated. According to the observation by way of a scanning type electron microscope, it was found that the individual fibers had 12 twists per 1 cm in average. 95% of the fiber lengths lay in the range of 5–40 mm, and 85% of the fiber diameters lay in the range of 5–8 μm. Shots were 11 per 10 g. These non-woven fabrics were softer compared with common carbon fiber non-woven fabrics, higher in compression elasticity, and superior in heat-retaining property.

EXAMPLE 2

By using the same nozzle and the same pitch as in Example 1, spinning was conducted. But Reynolds number of cooling air was changed. The results are shown in Table 1.

TABLE 1

Reynolds number of cooling air and properties of individual carbon fibers (after carbonization)

| Experiment No. | Re number | number of twist turn/cm | average fiber length (mm) | average fiber diameter (μm) | spinning state |
|---|---|---|---|---|---|
| 1 | 0.8 | <0.5 | 28 | 7 | good |
| 2 | 1.3 | 2.2 | 28 | 7 | good |
| 3 | 12.2 | 13.5 | 26 | 7 | good |
| 4 | 24 | 16.7 | 22 | 7 | good |
| 5 | 71 | 18.3 | 20 | 6 | good |
| 6 | 240 | 20.7 | 18 | 6 | normal |
| 7 | 300 | 20.3 | 16 | 6 | bad |

EXAMPLE 3

As a raw material pitch, the same pitch as in Example 1 was used. Spinning was conducted by using a spinneret having 200 spinning holes of 0.5 mm diameter on each of 5 rows of concentric circles. Spinneret temperature was 310° C. And cooling was conducted by using revolving type quenching apparatus having outlet part at the position 5–75 mm underneath the spinneret. The Reynolds number based upon the fiber diameter spun from the outmost circle row was set to 9.8. And after winding up on a bobbin at a winding rate of 250 m/min., infusibilization and carbonization treatment were conducted according to a common process.

Resulting individual carbon fibers were determined to have a strength of 230 kg/mm$^2$, an elongation of 0.7%, twist of 18 turns/cm and number of curls of 6.2/cm. By cutting these fibers into fiber length of 38 mm, spun yarn could be prepared by using a common spinning machine. Resulting spun yarn had a high bulkiness, a high elongation and a high compressive properties.

EXAMPLE 4

The melt blow spinning of the pitch was conducted by using a spinneret which was fabricated by inserting a tubular pitch spinning nozzle having an outside diameter of 0.6 mm and an inside diameter of 0.3 mm into a heated air blowing out nozzle having a diameter of 1.0 mm. This spinneret was produced with a plate having nozzles for blowing out of heated air which plate was made possible to slightly move relative to the other parts of the spinneret by sliding with screws. By this mechanism spinning was conducted by making the center of the pitch spinning nozzle eccentric to the center of the air blowing nozzle by 0.18 mm. As for a raw material pitch, a high softening isotropic pitch having a softening point of 238° C. was used. The spinning conditions were as follows.

| | |
|---|---|
| flow rate of pitch: | 8 g/min. |
| temperature of pitch: | 275° C. |
| heated air rate: | 0.84 kg/min. |
| temperature of heated air: | 368° C. |
| pressure of heated air: | 2.1 kg/cm$^2$ G |
| spinning hole: | 0.3 mmϕX48 holes |
| spinneret temperature: | 368° C. |

After spinning was conducted continuously for 6 hours, the resulting pitch fiber non-woven fabrics were subjected to infusibilization and carbonization. The shape of fibers was investigated by the random sampling at 10 positions of the resulting carbon fiber non-woven fabrics.

By the observation with a scanning type electron microscope, it was found that the individual fibers had 9 twists in average per 1 cm and 3 curls in average per 1 cm, 95% of the fiber lengths lay in the range of 5–40 mm and 85% of the fiber diameters lay in the range of 5–8 μm. Shots were 10 per 10 g.

EXAMPLE 5

The melt blow spinning of the pitch was conducted by using a spinneret which was fabricated by inserting the tubular pitch spinning nozzle having an outside diameter of 0.6 mm and an inside diameter of 0.3 mm in the nozzle having spiral groove for blowing out heated air. The spiral groove was one groove having a depth of 0.4 mm and the outside diameter of the screw (outside diameter of valley of the groove) was 1.2 mm and the inside diameter of screw (diameter of top of the groove) was 0.8 mm.

As for a raw material pitch, the same pitch as in Example 1 was used. The spinning conditions were as follows.

| | |
|---|---|
| flow rate of pitch: | 12 g/min. |
| temperature of pitch: | 320° C. |
| heated air rate: | 0.86 kg/min. |
| temperature of heated air: | 420° C. |
| pressure of heated air: | 2.1 kg/cm$^2$ G |
| spinning holes: | 0.3 mmϕX74 holes |
| spinneret temperature: | 420° C. |

After spinning was conducted continuously for 6 hours, the resulting pitch fiber non-woven fabrics were subjected to infusibilization and carbonization. The random sampling was conducted from 10 positions of the resulting carbon fiber non-woven fabrics. And the shape of fibers was investigated.

According to the observation by way of scanning type electron microscope, it was found that the individual fibers had 11 twists in average per 1 cm. 95% of the fiber lengths lay in the range of 5–40 mm, and 85% of the fiber diameters lay in the range of 5–8 μm. Shots were 13 per 10 g.

Function and Effectiveness of the Invention

This invention relates to pitch-based carbon fibers which show superior properties as carbon fibers useful for non-woven fabrics or fabrics and methods for production of the same.

The pitch based individual carbon fibers having peculiar twists or twists and curls of the present invention give bulkiness which has not been given by conventional carbon fibers. Produced non-woven fabrics show superior shape-retaining property, dimensional stability, heat-retaining property and cushioning property.

The pitch based carbon fibers of the present invention give superior shrinking property, shock absorbing property, heat-retaining property and cushioning property to thread or spun yarn. Resulting spun yarn shows superior properties for filter material and gland packing material.

What is claimed is:

1. Pitch based individual carbon fiber having from 2 to 200 twists per 1 cm length.

2. Pitch based individual carbon fiber having from 2 to 200 twists per 1 cm length and curls.

* * * * *